US005119992A

United States Patent [19]

Grime

[11] Patent Number: 5,119,992

[45] Date of Patent: Jun. 9, 1992

[54] SPRAY GUN WITH REGULATED PRESSURE FEED PAINT CUP

[75] Inventor: Thomas E. Grime, Temperance, Mich.

[73] Assignee: Ransburg Corporation, Indianapolis, Ind.

[21] Appl. No.: 653,712

[22] Filed: Feb. 11, 1991

[51] Int. Cl.[5] ..... B05B 7/24

[52] U.S. Cl. ..... 239/364; 239/337; 239/373

[58] Field of Search ..... 239/337, 340, 346, 364-369, 239/373

[56] References Cited

U.S. PATENT DOCUMENTS

| | | | |
|---|---|---|---|
| 2,757,048 | 7/1956 | Balmer | 239/340 |
| 2,886,252 | 5/1959 | Ehrensperger | 239/364 |
| 3,547,350 | 12/1970 | Marcoux | 239/337 |
| 3,945,571 | 3/1976 | Rash | 239/337 |
| 4,174,070 | 11/1979 | Lau et al. | 239/340 |
| 5,054,687 | 10/1991 | Burns et al. | 239/337 |

FOREIGN PATENT DOCUMENTS

| | | | |
|---|---|---|---|
| 504615 | 7/1951 | Belgium | 239/365 |
| 714406 | 7/1965 | Canada | 239/366 |
| 837683 | 6/1960 | United Kingdom | 239/365 |

*Primary Examiner*—Andres Kashnikow
*Assistant Examiner*—Lesley D. Morris
*Attorney, Agent, or Firm*—Macmillan, Sobanski & Todd

[57] ABSTRACT

An improved paint spray gun with a regulated pressure feed paint cup. High pressure air is supplied through a hose and a fitting to the spray gun handle. The air pressure is reduced to a low pressure high volume flow within the gun for atomizing the paint. The inlet of a pressure regulator is connected through a quick connect fitting directly to the gun handle for receiving high pressure air. The regulator outlet is connected through a flexible hose to a barbed fitting on a check valve on a paint cup lid for applying a controlled paint feed pressure to the cup. The location of the regulator does not adversely affect the maneuverability or balance of the gun during use and the regulator can be quickly disconnected from the gun to facilitate cleaning the gun.

5 Claims, 1 Drawing Sheet

SPRAY GUN WITH REGULATED PRESSURE FEED PAINT CUP

TECHNICAL FIELD

The invention relates to paint spray guns and more particularly to a high volume low pressure air atomization paint spray gun having a regulated pressure feed paint cup.

BACKGROUND ART

One general type of liquid paint spray gun uses pressurized air for atomizing the paint and for shaping the pattern of the atomized paint. Generally, a relatively low flow of compressed air at between 25 psig and 90 psig has been used for paint atomization. This relatively high pressure air is quite effective at paint atomization. However, the high air pressure imparts a high velocity to the atomized paint. As a consequence of the high velocity, a significant portion of the atomized paint fails to deposit on the workpiece being coated. Such paint ends up in the surrounding environment. In recent years, there has been an increased emphases on using high volume low pressure (HVLP) air for paint atomization because it can produce a soft spray with a resulting higher transfer of the atomized paint to the workpiece. In the industry, HVLP has generally been understood as a flow of air at no greater than 10 psig. HVLP guns are designed either to operate from a low pressure turbine which supplies the pressurized air at no greater than 10 psig or to operate from a high pressure air line. When operated from a high pressure air line, calibrated orifices internal to the spray gun have been used to drop the air pressure to the desired level.

Generally, a paint cup is attached directly to a hand held spray gun barrel. When the gun is of the type operated from high pressure air, typically the flow of atomization air through a nozzle assembly is used to produce suction which causes the paint to flow from the cup to the fluid tip. When higher viscosity materials are being atomized, it is sometimes necessary to pressurize the paint cup to achieve adequate paint flow.

For HVLP spray guns, pressurized paint feed is generally required because the low air pressure is inadequate to establish the desired paint flow from the cup to the fluid tip. However, there have been problems in achieving the desired paint cup pressure from a low pressure system. The air passages in the spray gun normally cannot be connected directly to pressurize the paint cup because the air pressure in the gun typically is about 10 psig while the ideal paint cup pressure may be about 2 to 3 psig. It will be noted that the volume of air in the paint cup is essentially static, since the air volume changes only as paint is slowly fed to the gun. Because of the low flow, a simple needle valve will not work for adjusting the paint cup pressure.

One prior art HVLP spray gun has placed an air pressure regulator between the spray gun barrel and the paint cup. Although this can produce the desired cup pressure, it also has some inherent problems. If the gun is tipped to paint a horizontal surface, there is a risk that paint will enter the regulator. Further, laws in some governmental jurisdictions such as California require that the spray gun and cup be cleaned in a closed gun cleaner which reduces the discharge of paint solvent vapors into the environment. The regulator cannot be placed in such gun cleaners and it is not easily removed from the gun and cup assembly.

In another prior art HVLP spray gun of the type operated from a high pressure compressed air source, a regulator is attached to the spray gun handle in series with the compressed air supply hose. The regulator is connected for supplying the desired low air pressure to the paint cup. The controlled low pressure outlet from the regulator is connected through a flexible hose and a barbed fitting on a check valve to the paint cup lid for pressurizing the cup. The check valve reduces the risk of paint entering the regulator when the spray gun and cup assembly is tipped during use. This arrangement functions well for controlling the paint feed pressure. However, this arrangement also has disadvantages. The regulator body must have an unregulated passage to handle the full air flow to the gun plus the regulated port to the cup. Further, the pressure regulator adds about 7 to 8 cm (about 3 inches) to the length of the handle. Again, the regulator is not quickly removable for placing the spray gun in a closed gun cleaner. If quick connect fittings are used to permit quick removal of the regulator for cleaning, the end of the paint hose is further removed from the spray gun handle. Spacing the point of attachment of the flexible air hose 7 to 8 cm or more below the gun handle has a significant adverse affect on the balance of the spray gun during use. For good maneuverability, the flexible air hose should be attached directly to the gun handle. Further, spacing the point of attachment 7 to 8 cm below the handle can prevent setting the gun upright on a bench and also can cause an imbalance due to the distance from the center of gravity of the gun and cup. Consequently, the gun and cup can tip easily.

There is a need for an HVLP spray gun having a regulated pressure feed paint cup in which the pressure regulator is easily disconnected from the gun to permit cleaning the gun in a closed gun cleaner and in which the regulator does not adversely affect the maneuverability and balance of the gun during use.

DISCLOSURE OF INVENTION

The invention is directed to an improved HVLP spray gun with a regulated pressure feed paint cup. The spray gun and cup assembly includes a pressure regulator for controlling the cup pressure which may be quickly detached to facilitate cleaning the gun and cup in a closed cleaner and which does not adversely affect the maneuverability and balance of the gun during use. The spray gun is provided with a conventional first fitting at the lower end of the handle for attachment directly to a compressed air hose. This fitting may be of the quick connect type to facilitate disconnecting the air hose. A second quick connect fitting is provided on the lower end of the gun handle for attachment to an adjustable air pressure regulator. This regulator has an inlet which received compressed air through the gun handle from the air hose. A low pressure outlet from the regulator is connected through a flexible hose to a smooth barbed fitting and a check valve on the paint cup lid for pressurizing the paint cup. During cleaning of the gun and paint cup, the flexible hose is simply pulled from the barbed fitting on the paint cup lid and the regulator is removed from the gun handle with the quick disconnect fitting. During use, the presence of the regulator does not change the effective location that the flexible air supply hose is connected to the rigid gun handle and consequently does not adversely affect the maneuverability or balance of the gun. Further, the regulator is located closer to the center of gravity of the gun and cup and, accordingly, the gun and cup are more stable when placed on a bench or other surface.

Accordingly, it is an object of the invention to provide an improved HVLP paint spray gun having a regulated pressure feed paint cup.

Other objects and advantages of the invention will be apparent from the following detailed description of the preferred embodiments and the accompanying drawings.

BEST MODE FOR CARRYING OUT THE INVENTION

Figure 1:
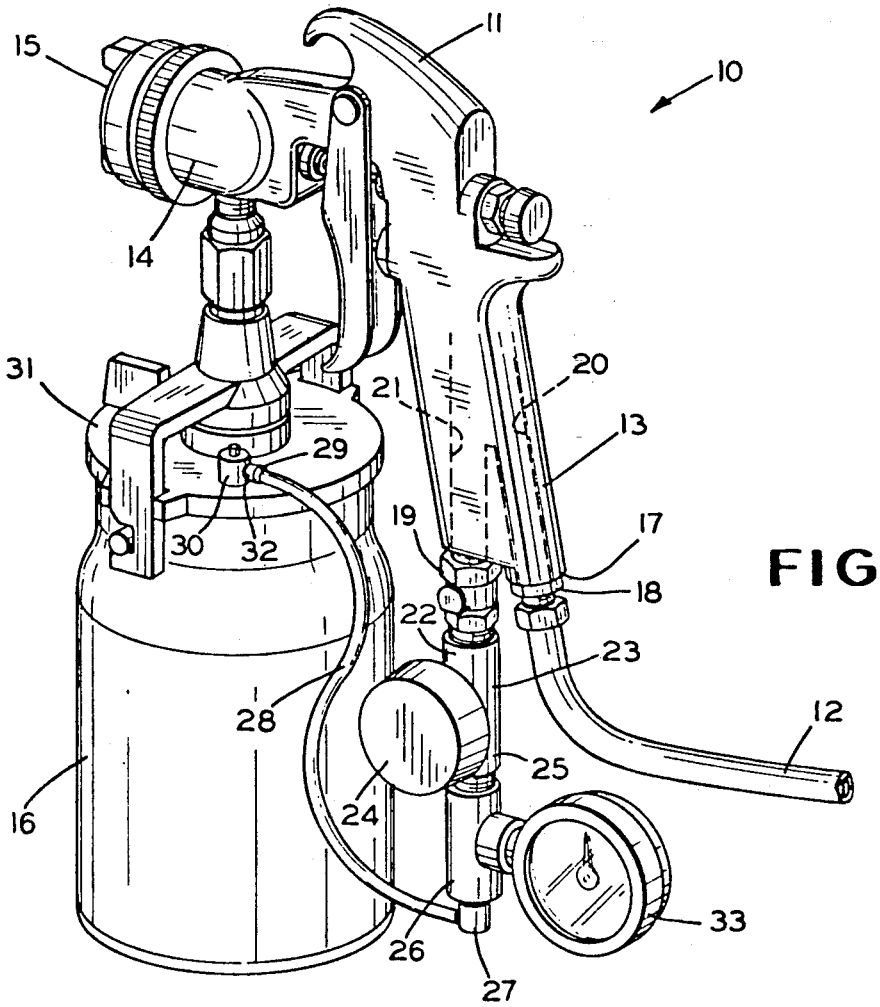
FIG. 1 is a left rear side perspective view of a paint spray gun and cup assembly according to the invention with a pressure regulator attached to the gun handle for supplying a regulated air pressure to the paint cup.

Turning to FIG. 1 of the drawings, an improved paint spray gun assembly 10 is illustrated according to the invention. The spray gun assembly includes an HVLP paint spray gun 11 of the type operated from a high pressure air hose 12. The air hose 12 supplies compressed air, for example, at a desired pressure between 60 and 90 psig. Orifices (not shown) within the spray gun 11 reduce the relatively low flow of high pressure air to a high volume flow of low pressure air, which is preferably less than 10 psig, for atomizing paint and for shaping the pattern of the atomized paint, as is known in the painting art. The spray gun 11 includes a handle 13, a barrel 14 and a nozzle assembly 15 at which the paint is discharged from the gun 11 and atomized. A closed (non vented) paint cup 16 is attached to and extends below the barrel 14 for supplying paint through the barrel 14 to the nozzle assembly 15.

The spray gun handle 13 has a free end 17. The air hose 12 is connected to a fitting 18 attached to the free handle end 17. Preferably, the fitting 18 is of the quick disconnect type which permits quick disconnect of the air hose when the spray gun assembly 10 is to be cleaned. A quick disconnect fitting 19 is attached to the handle end 17 between the fitting 18 and the paint cup 16. The fitting 18 is connected to an internal passage 20 in the gun handle 13 and the fitting 19 is connected to an internal passage 21 in the gun handle 13. The passages 20 and 21 are interconnected so that compressed air supplied from the hose 12 flows into the handle passage 20 and through the handle passage 21 to the fitting 19. An inlet side 22 of an air pressure regulator 23 is attached to the quick disconnect fitting 19. The regulator 23 includes a knob 24 for adjusting the air pressure at an outlet side 25 of the regulator 23. The outlet side 25 is connected through a manifold 26 and a barbed fitting 27 to a flexible hose 28. A barbed fitting 29 is attached to a check valve 30 mounted on a lid 31 to the paint cup 16. An end 32 of the hose 28 is attached to the barbed fitting 29 to supply air pressure from the hose 28 through the check valve 30 to the closed paint cup 16. The regulator knob 24 is manually adjusted to establish a desired pressure within the paint cup 16 to in turn produce a desired paint feed pressure. A gauge 33 is attached to the manifold 26 to indicate the pressure of the compressed air applied to the paint cup 16.

Figure 2:
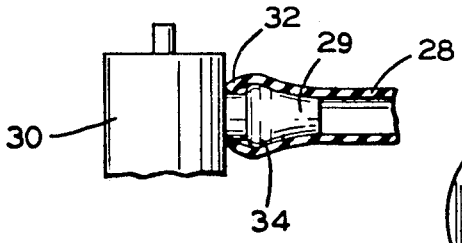
FIG. 2 is an enlarged fragmentary cross sectional view showing details of the barbed fitting for attaching the hose to the paint cup.

FIG. 2 illustrates a preferred embodiment of the barbed fitting 29 for attaching the end 32 of the hose 28 to the paint cup lid 31. Preferably, the fitting 29 has a smooth barb 34 over which the hose end 32 slides. The smooth barb 34 is effective for retaining the hose end 32 under the normal operating pressures, while permitting the hose end 32 to be pulled from the barb 34 when the hose 28 is to be disconnected from the paint cup 16.

During operation of the spray gun assembly 10, the regulator knob 24 is adjusted to provide the desired paint feed pressure to the cup 16. The check valve 30 reduces the likelihood that paint will enter the hose 28 when the gun 11 is tilted to paint horizontal surfaces. However, if any paint should enter the hose 28, locating the fitting 27 below the gauge 33 and the regulator 23 forms a trap which reduces the risk that such paint will enter the gauge 33 or the regulator 23. After painting is completed, the regulator 23 is quickly and easily disconnected from the spray gun 11 by disconnecting the quick disconnect fitting 19 from the gun handle 13 and pulling the hose end 32 from the cup fitting 29. The air hose 12 also is disconnected and the gun and cup may be placed in a closed gun cleaner. From FIG. 1, it will be appreciated that by connecting the regulator 23 to the gun handle end 17 separate from the connection of the air hose 12, the balance and maneuverability of the gun assembly 10 is not adversely affected by the regulator 23. Further, by locating the regulator fitting 19 between the air hose fitting 18 and the cup 16, the regulator 23 does not interfere with the air hose 12 during use of the gun assembly 10. Nor does the regulator 23 interfere with setting the gun assembly 10 on a bench between uses.

Figure 3:
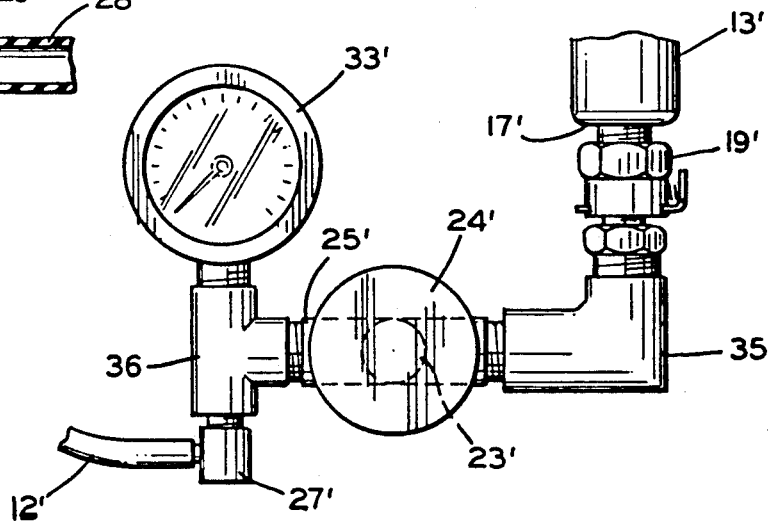
FIG. 3 is a fragmentary rear elevational view of a modified embodiment of a pressure regulator and meter attached to the handle of the paint spray gun of FIG. 1.

FIG. 3 is a fragmentary view illustrating a modified connection of the regulator 23' to the free end 17' of a spray gun handle 13'. An elbow fitting 35 is releasably secured to the quick disconnect fitting 19' on the handle end 17'. The regulator 23' is secured to the elbow fitting 35 to extend to one side of the handle 13'. A T fitting 36 is connected to the outlet 25' of the regulator 23'. The gauge 33' is attached to one end of the T fitting 36 and the barbed fitting 27' to which the hose 12' is secured is attached to the other end of the T fitting 36. In the embodiment of FIG. 3, both the gauge 33' and the regulator knob 24' are located to one side of the handle 13' to allow the spray gun user to hold the gun handle 13' with one hand and to easily read the cup pressure on the gauge 33' as the knob 24' is adjusted.

From the above, it will be seen that by mounting a paint cup pressure regulator on the spray gun handle with a quick disconnect fitting separate from the fitting to which the compressed air hose is attached, the maneuverability and balance of the spray gun are not adversely affected by the regulator. Further, such a mounting location permits the use of a quick disconnect fitting which facilitates removal of the regulator during cleaning of the spray gun and cup assembly. It will be appreciated that various modifications and changes may be made to the above described preferred embodiments of the invention without departing from the spirit and the scope of the following claims.

I claim:

1. An improved paint spray gun including a gun barrel and handle, said handle having a free end, a nozzle assembly attached to said barrel, a closed paint cup attached to said gun barrel, said paint cup having a lid with an attached first fitting for receiving pressurized air to cause paint to flow from said cup through said gun barrel to said nozzle, a second fitting on said free handle end for attachment directly to a compressed air supply hose, said gun characterized by a third fitting on said free handle end, a passage in said gun connecting said second and third fittings, an adjustable pressure regulator having an inlet attached to said third fitting for receiving compressed air from said gun handle, said regulator having an outlet, a second hose connecting said regulator outlet to said first fitting on said cup lid, and means forming a trap for any paint entering said second hose from said paint cup.

2. An improved paint spray gun, as set forth in claim 1, and further being characterized by said third fitting being a quick disconnect fitting and said first fitting being a smooth barbed fitting for receiving an end of said second hose whereby said regulator may be quickly removed from and reattached to said spray gun.

3. An improved paint spray gun including a gun barrel and handle, said handle having a free end, a nozzle assembly attached to said barrel, a closed paint cup attached to said gun barrel, said paint cup having a lid with an attached first fitting for receiving pressurized air to cause paint to flow from said cup through said gun barrel to said nozzle, a second fitting on said free handle end for attachment directly to a compressed air supply hose, said gun characterized by a third fitting on said free handle end, a passage in said gun connecting said second and third fittings, an adjustable pressure regulator having an inlet attached to said third fitting for receiving compressed air from said gun handle, said regulator having an outlet, a second hose connecting said regulator outlet to said first fitting on said cup lid, and a fourth fitting attached between said regulator outlet and said second hose, said fourth fitting being located below said regulator when said spray gun is in an upright position, said fourth fitting forming a trap for any paint entering said second hose from said paint cup.

4. An improved paint spray gun, as set forth in claim 3, and further being characterized by a check valve attached to said cup lid, wherein said first fitting is attached to said check valve and wherein said check valve allows air to flow from said second hose to said paint cup while preventing paint from flowing from said paint cup to said second hose.

5. An improved paint spray gun, as set forth in claim 1, and further being characterized by said third fitting being located between said second fitting and said paint cup, whereby said regulator does not interfere with the maneuverability of said spray gun relative to said compressed air hose.

* * * * *